US009387564B2

(12) United States Patent
Matsushita et al.

(10) Patent No.: US 9,387,564 B2
(45) Date of Patent: Jul. 12, 2016

(54) GLASS SHEET PROCESSING APPARATUS AND GLASS SHEET PRODUCING METHOD

(71) Applicant: Nippon Electric Glass Co., Ltd., Shiga (JP)

(72) Inventors: Tetsuya Matsushita, Shiga (JP); Koji Ichikawa, Shiga (JP)

(73) Assignee: Nippon Electric Glass Co., Ltd., Shiga (JP)

( * ) Notice: Subject to any disclaimer, the term of this patent is extended or adjusted under 35 U.S.C. 154(b) by 0 days.

(21) Appl. No.: 14/407,039

(22) PCT Filed: Jun. 11, 2013

(86) PCT No.: PCT/JP2013/066060

§ 371 (c)(1),
(2) Date: Dec. 10, 2014

(87) PCT Pub. No.: WO2013/187400

PCT Pub. Date: Dec. 19, 2013

(65) Prior Publication Data

US 2015/0174724 A1 Jun. 25, 2015

(30) Foreign Application Priority Data

Jun. 13, 2012 (JP) ..... 2012-134021

(51) Int. Cl.
*B24B 9/10* (2006.01)

(52) U.S. Cl.
CPC . *B24B 9/10* (2013.01); *B24B 9/102* (2013.01); *B24B 9/105* (2013.01)

(58) Field of Classification Search
CPC ..... B24B 9/10; B24B 9/102; B24B 9/105
USPC ..... 451/5, 44
See application file for complete search history.

(56) References Cited

U.S. PATENT DOCUMENTS 3,813,823 A * 6/1974 Southland ..... B24B 3/06 451/217
4,575,970 A * 3/1986 Kozai ..... B24B 49/16 451/14
5,099,617 A * 3/1992 Bovone ..... B24B 9/10 451/231
5,713,784 A * 2/1998 Miller ..... B24B 9/107 451/14
6,344,259 B1 * 2/2002 Tanaka ..... B24B 9/10 428/192

(Continued)

FOREIGN PATENT DOCUMENTS

CN 2702813 Y 6/2005
JP S46-16237 B 5/1971

(Continued)

OTHER PUBLICATIONS

International Search Report; PCT/JP2013/066060; Jul. 23, 2013.

(Continued)

*Primary Examiner* — George Nguyen
(74) *Attorney, Agent, or Firm* — Studebaker & Brackett PC

(57) ABSTRACT

A glass sheet processing apparatus processes an edge surface of a glass sheet using a processing tool. The glass sheet processing apparatus includes a pressing force generation element and a buffering element. The pressing force generation element generates a pressing force that the processing tool exerts on the edge surface of the glass sheet. The buffering element buffers an impact force that the edge surface of the glass sheet exerts on the processing tool.

14 Claims, 14 Drawing Sheets

(56) References Cited

U.S. PATENT DOCUMENTS

| | | | | |
|---|---|---|---|---|
| 7,018,272 | B2 * | 3/2006 | Allaire | B24B 9/102 451/11 |
| 7,207,866 | B2 | 4/2007 | Allaire et al. | |
| 2005/0026541 | A1 | 2/2005 | Allaire et al. | |
| 2006/0121832 | A1 | 6/2006 | Allaire et al. | |
| 2015/0174724 | A1 * | 6/2015 | Matsushita | B24B 9/102 451/44 |

FOREIGN PATENT DOCUMENTS

| | | | |
|---|---|---|---|
| JP | S54-17595 | A | 2/1979 |
| JP | S61-079559 | A | 4/1986 |
| JP | H05-12072 | U | 2/1993 |
| JP | H11-300612 | A | 11/1999 |
| JP | 2000-176804 | A | 6/2000 |
| JP | 2004-167633 | A | 6/2004 |
| JP | 2007-500605 | A | 1/2007 |
| JP | 2008-093744 | A | 4/2008 |

OTHER PUBLICATIONS

An Office Action issued by the Chinese Patent Office on Dec. 28, 2015, which corresponds to Chinese Patent Application No. 2013800303671 and is related to U.S. Appl. No. 14/407,039.

* cited by examiner

GLASS SHEET PROCESSING APPARATUS AND GLASS SHEET PRODUCING METHOD

TECHNICAL FIELD

The present invention relates to glass sheet processing apparatuses for processing an edge surface of a glass sheet using a processing tool and glass sheet producing methods for producing a glass sheet.

BACKGROUND ART

In the field of glass sheets, glass sheets have been increased in size for improvement in efficiency of production of liquid crystal displays and increase in size of liquid crystal displays. A glass sheet increased in size can yield more glass substrates and thus improve production efficiency as well as allow production of glass substrates compatible with large-sized liquid crystal displays.

If a glass sheet has a flaw in a selvage part thereof, the flaw may develop into a crack or the like in the glass sheet. Selvage parts of a glass sheet are therefore chamfered. Furthermore, in order to increase throughput per unit time and lower the production cost, the speed of conveying (speed of processing) a glass sheet is increased.

By observing an edge surface of a glass sheet subjected to the chamfering through a microscope, fine projections and recesses can be found on the edge surface of the glass sheet. Such a glass sheet may have a chip or a crack in a following process (process by a customer), and therefore the edge surface of the glass sheet is polished into an even surface. However, in order to polish the edge surface of the glass sheet into an even surface, an area of the glass sheet reserved for the polishing needs to be set larger. Accordingly, the polishing time is increased, and it is difficult to further increase the glass sheet conveyance speed (processing speed). Besides, when an edge surface of an enlarged and thinned glass sheet is polished, a counter force to the processing force from a grinding or polishing tool to the glass sheet (grinding resistance or polishing resistance) strongly acts, causing a chip or a crack in the edge surface of the glass sheet.

Various methods for processing an edge surface of a glass sheet having microscopic projections and recesses on the edge surface of the glass sheet have been invented (Patent Literatures 1 to 3).

CITATION LIST

Patent Literature

[PTL 1] Japanese Patent Application Laid-Open Publication No. 2000-176804

[PTL 2] Japanese Patent Application Laid-Open Publication No. 2004-167633

[PTL 3] Japanese Patent Application Laid-Open Publication No. 2007-500605

SUMMARY OF INVENTION

Technical Problem

However, conventional processing methods have a limitation in increasing the glass sheet conveyance speed (processing speed). If the speed is increased, for example, a processing tool is flicked off the edge surface of the glass sheet by an impact force generated because of the presence of the microscopic projections and recesses on the edge surface of the glass sheet A (an impact force that the edge surface of the glass sheet exerts on the processing tool (grinding stone)). It is therefore difficult to increase the conveyance speed (processing speed) to a desired processing speed.

In view of the above-described problem, the present invention has been made to provide a glass sheet processing apparatus and a glass sheet producing method capable of preventing a processing tool used therein from being flicked off an edge surface of a glass sheet and capable of processing the edge surface of the glass sheet at a high conveyance speed (processing speed).

Solution to Problem

A glass sheet processing apparatus according to the present invention processes an edge surface of a glass sheet using a processing tool and includes: a pressing force generation element configured to generate a pressing force that the processing tool exerts on the edge surface of the glass sheet; and a buffering element configured to buffer an impact force that the edge surface of the glass sheet exerts on the processing tool.

In the glass sheet processing apparatus according to the present invention, preferably, the buffering element buffers only a first force that the edge surface of the glass sheet exerts on the processing tool without buffering a second force that the processing tool exerts on the edge surface of the glass sheet.

Preferably, the glass sheet processing apparatus according to the present invention further includes a position control section configured to control the processing tool such that it is shifted in sequence among a standby position, a polishing position, and a retraction position, wherein the standby position is where the processing tool is on standby for contact with the edge surface of the glass sheet, the polishing position is where the processing tool is in contact with the edge surface of the glass sheet and is polishing the edge surface, and the retraction position is where the processing tool has been retracted in a direction to separate the processing tool from the edge surface of the glass sheet beyond the standby position.

In the glass sheet processing apparatus according to the present invention, preferably, the buffering element is a dashpot.

In the glass sheet processing apparatus according to the present invention, preferably, the dashpot includes water as a working fluid.

In the glass sheet processing apparatus according to the present invention, preferably, the dashpot includes a piston mechanism, and the piston mechanism has a non-return valve to be closed to an action of the impact force.

Preferably, the glass sheet processing apparatus according to the present invention includes a rotary arm member and a support shaft member, wherein the processing tool is connected with the rotary arm member, the rotary arm member is rotatably connected with the support shaft member, and the pressing force generation element generates the pressing force by applying a couple of forces to the arm member.

In the glass sheet processing apparatus according to the present invention, preferably, the position control section includes a cam member to be rotationally driven and a cam follower to be driven by the rotation of the cam member, the rotary arm member operates in conjunction with the cam follower, the cam follower is displaced relative to the cam member to apply a couple of forces to the rotary arm member, and the processing tool is shifted to the standby position, the polishing position, or the retraction position in response to the application of the couple of forces to the rotary arm member.

In the glass sheet processing apparatus according to the present invention, preferably, the cam follower includes a first cam follower and a second cam follower configured to be movable while maintaining a predetermined gap therebetween; the cam member is a cylindrical end cam having, on one side, a first cam surface capable of being brought into contact with the first cam follower and, on the other side, a second cam surface capable of being brought into contact with the second cam follower; the processing tool is shifted in sequence among the standby position, the polishing position, and the retraction position by change in the position and state of contact between the first cam surface and the first cam follower, and the position and state of contact between the second cam surface and the second cam follower in conjunction with the rotation of the cam member; the rotary arm is in a locked state, in which it is non-rotatable, in the standby position and the retraction position; and the rotary arm is in a free state, in which it is rotatable, in the processing position.

In the glass sheet processing apparatus according to the present invention, preferably, the processing tool is shifted to the standby position when the cam member is rotated by a first rotation phase, the processing tool is shifted to the polishing position when the cam member is rotated by a second rotation phase, the processing tool is shifted to the retraction position when the cam member is rotated by a third rotation phase, a width of the cam member with respect to a portion thereof that comes between the first cam follower and the second cam follower in the case of the first rotation phase and the third rotation phase is equal to the gap between the first cam follower and the second cam follower, the width of the cam member with respect to a portion thereof that comes between the first cam follower and the second cam follower in the case of the second rotation phase is smaller than the gap between the first cam follower and the second cam follower, and the position of the first cam surface in the case of the third rotation phase is offset toward one side in an axial direction of the cam member by a predetermined distance from the position of the first cam surface in the case of the first rotation phase.

Preferably, the glass sheet processing apparatus according to the present invention includes a slide member and a slide rail member, wherein the processing tool is connected with the slide member, and the slide member is connected with the slide rail member in a linearly slidable manner; and the pressing force generation element generates the pressing force by pressing the slide member.

In the glass sheet processing apparatus according to the present invention, preferably, the buffering element includes a Scott Russel linkage mechanism configured to convert a direction in which the impact force acts from the horizontal direction into the vertical direction.

A glass sheet processing apparatus according to the present invention processes an edge surface of a glass sheet using a processing tool, including: a pressing force generation element configured to generate a pressing force that the processing tool exerts on the edge surface of the glass sheet; and a position control section configured to control the processing tool such that it is shifted in sequence among a standby position, a polishing position, and a retraction position, wherein the standby position is where the processing tool is on standby for contact with the edge surface of the glass sheet, the polishing position is where the processing tool is in contact with the edge surface of the glass sheet and is polishing the edge surface, and the retraction position is where the processing tool has been retracted in a direction to separate the processing tool from the edge surface of the glass sheet beyond the standby position.

A glass sheet producing method according to the present invention is a glass sheet producing method for producing a glass sheet having a processed edge surface by processing the edge surface of the glass sheet using a processing tool, including generating a pressing force that the processing tool exerts on the edge surface of the glass sheet while buffering an impact force that the edge surface of the glass sheet exerts on the processing tool.

A glass sheet producing method according to the present invention is a glass sheet producing method for producing a glass sheet having a processed edge surface by processing the edge surface of the glass sheet using a processing tool, including controlling the processing tool such that it is shifted in sequence among a standby position, a polishing position, and a retraction position.

Advantageous Effects of Invention

According to the glass sheet processing apparatus and the glass sheet producing method of the present invention, it is possible to buffer an impact force that an edge surface of a glass sheet exerts on a processing tool. It is therefore possible to prevent the processing tool from being flicked off the edge surface of the glass sheet by the impact force on the glass sheet that is increased with the increase in the glass sheet conveyance speed. As a result, the conveyance speed in the glass sheet production can be increased, and the quantity of glass sheets that can be conveyed to a following process can be increased.

DESCRIPTION OF EMBODIMENTS

Hereinafter, embodiments of a glass sheet processing apparatus and a glass sheet producing method of the present invention will be described with reference to the accompanying drawings. However, the present invention is not limited to the following embodiments.

[Glass Sheet Processing Apparatus (Basic Principle)]

Figure 1:
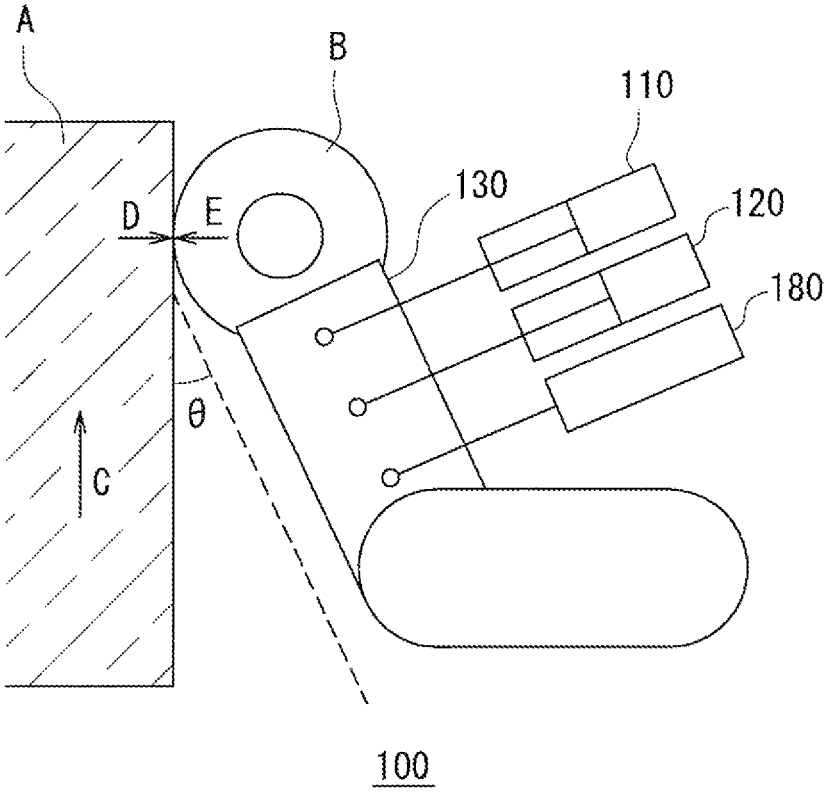
FIG. 1 is a schematic top view of a glass sheet processing apparatus 100 according to an embodiment of the present invention.

FIG. 1 is a schematic top view of a glass sheet processing apparatus 100 according to an embodiment of the present invention. The glass sheet processing apparatus 100 processes an edge surface of a glass sheet A using a processing tool B. The glass sheet processing apparatus 100 includes a pressing force generation element 110 and a buffering element 120.

The glass sheet A has a shape of a rectangular plate. The glass sheet A has a thickness of 0.05 mm to 10 mm, for example. However, the present invention is not limited thereto. The present invention can be applied to processing of a glass sheet A having a non-rectangular shape (e.g., polygonal shape) and processing of a glass sheet A having a thickness outside the range of 0.05 mm to 10 mm.

The processing tool B processes an edge surface of the glass sheet A. The processing of an edge surface of the glass sheet A can be polishing for evening projections and recesses on a chamfered edge surface. Alternatively, the processing of an edge surface of the glass sheet A can be chamfering of the edge surface of the glass sheet A.

The glass sheet A moves relative to the processing tool B. For example, the processing tool B in a fixed state processes the glass sheet A moving in a glass sheet feed direction C. Alternatively, the processing tool B moving in the feed direction C can process the glass sheet A in a fixed state. The processing tool B is a grinding stone to be driven and rotated, for example. The grinding stone polishes the edge surface of the glass sheet A while being rotated.

The smaller the diameter of the grinding stone is, the smaller the contact area between the glass sheet A and the grinding stone is. Accordingly, the polishing resistance that the grinding stone receives from the glass sheet A is reduced, and the grinding stone can follow the edge surface of the glass sheet A more easily. The polishing resistance can be reduced by reducing the contact area between the glass sheet and the grinding stone. In the embodiment of the present invention, a grinding stone having a diameter of 150 mm can be used.

The pressing force generation element 110 generates a pressing force that the pressing tool B exerts on the edge surface of the glass sheet A. For example, the pressing force generation element 110 may be a low sliding resistance air cylinder. In the embodiment of the present invention, a diaphragm cylinder may be used as the low sliding resistance air cylinder in view of its high responsiveness owing to the low slidability, its long life owing to the absence of a piston, and the like.

The buffering element 120 buffers an impact force that the edge surface of the glass sheet A exerts on the processing tool B. The impact force that the edge surface of the glass sheet A exerts on the processing tool B is generated because of the presence of microscopic projections and recesses on the edge surface of the glass sheet A, for example.

The buffering element 120 functions as a damper element and may be a dashpot, for example. The buffering element 120 in the embodiment of the present invention is an unsealed water dashpot, which can utilize, as a buffering effect, the resistance generated when water passes between a piston and a tube. For example, the buffering element 120 may have a non-return valve thereby to buffer only the first force that the edge surface of the glass sheet A exerts on the processing tool B without buffering the second force that the processing tool B exerts on the edge surface of the glass sheet A (here, the first force acts in the direction indicated by the arrow D, whereas the second force acts in the direction indicated by the arrow E). The buffering element 120 will be described later in detail with reference to FIGS. 4 to 6.

The glass sheet processing apparatus 100 may further include an arm member 130 and a position control section 180. The arm member 130 is connected with the processing tool B. The pressing force generation element 110 generates a pressing force against the processing tool B by applying a couple of forces to the arm member 130. Preferably, the advance direction of the glass sheet A and the arm member 130 form an included angle (angle θ shown in FIG. 1) of 25° to 35°.

The position control section 180 controls the position of the processing tool B connected with the arm member 130 by controlling the position of the arm member 130. The position control section 180 includes an inter-cylinder cam and an arm controlling element, for example. The position control section 180 controls the position of the arm member 130 by controlling the rotation of the inter-cylinder cam such that the processing tool B is shifted in sequence among three positions: a standby position (original point), a polishing position (where the arm is free), and a retraction position. The inter-cylinder cam is controlled by the position control section 180. The position of the processing tool B can be shifted among the three positions including the positions where the arm member 130 is locked (the standby position and the retraction position) within a second, for example. Thus, the arm member 130 can be controlled at a high speed.

The arm member 130 is unlocked at the polishing position. That is, the arm member 130 is in an arm-free state (in an unlocked state). The pressing force generation element 110 applies a couple of forces to the arm member 130 in the arm-free state thereby to generate a pressing force against the processing tool B.

As described with reference to FIG. 1, the glass sheet processing apparatus 100 of the present invention can buffer the impact force that the edge surface of the glass sheet A exerts on the processing tool B. Thus, it is possible to prevent the processing tool B from being flicked off the edge surface of the glass sheet A because of the presence of the impact force on the glass sheet A, which is increased with the increase in the conveyance speed of the glass sheet A. As a result, the conveyance speed in the glass sheet production can be increased, and the quantity of glass sheets A that can be conveyed to a following process can be increased.

The glass sheet processing apparatus 100 may be of a swivel type or a linear slide type, for example. Hereinafter, a swivel type glass sheet processing apparatus 200 and a linear slide type glass sheet processing apparatus 300 will be described as examples of the glass sheet processing apparatus 100.

[Swivel Type Glass Sheet Processing Apparatus]

Figure 2:
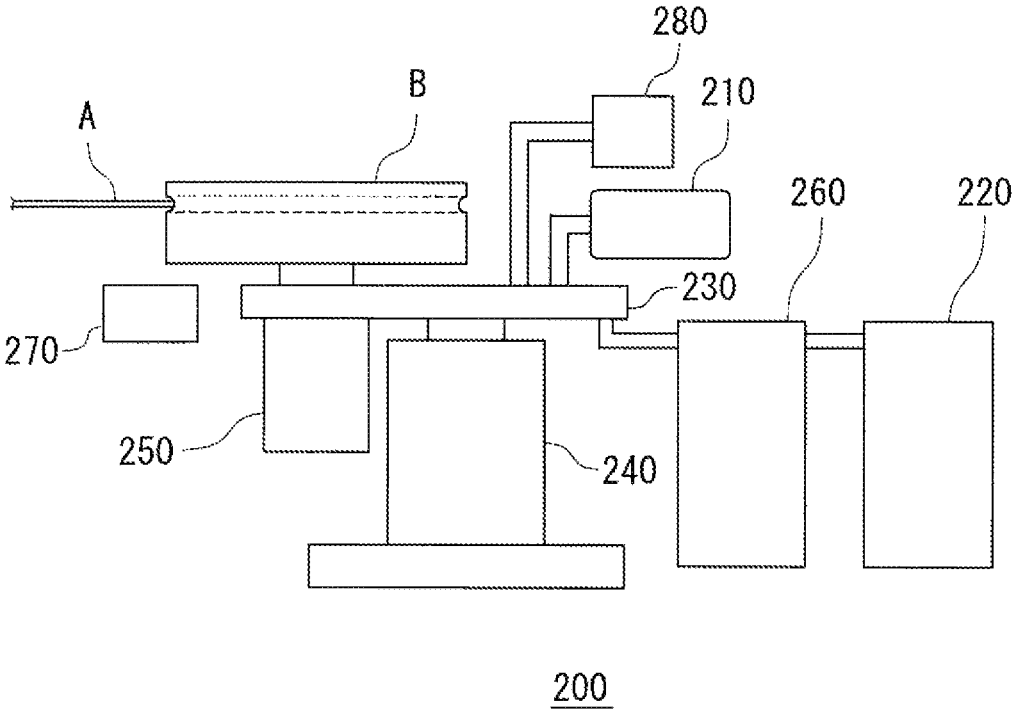
FIG. 2 is a schematic side view of a swivel type glass sheet processing apparatus 200 according to an embodiment of the present invention.

FIG. 2 is a schematic side view of the swivel type glass sheet processing apparatus 200 according to an embodiment of the present invention. The swivel type glass sheet processing apparatus 200 processes the edge surface of the glass sheet A using the processing tool B. The swivel type glass sheet processing apparatus 200 includes a pressing force generation element 210, a buffering element 220, a rotary arm member 230, a support shaft member 240, a processing tool rotating motor 250, and a linkage mechanism 260.

The rotary arm member 230 is connected with the processing tool B. The support shaft member 240 is rotatably connected with the rotary arm member 230. The pressing force generation element 210 generates a pressing force from the processing tool B toward the glass sheet A by applying a couple of forces to the rotary arm member 230.

The processing tool rotating motor 250 rotates the processing tool B. A larger output from the processing tool rotating motor 250 can offer a larger resistance against a bound from the edge surface of the glass sheet A, allowing stable processing. However, this requires operation needing monitoring of the motor current value (motor load factor). Accordingly, a motor that clearly shows change in the motor current value and has a capacity not adversely affecting the bound is selected. The output of the processing tool rotating motor 250 may be 1 kW, for example.

The linkage mechanism 260 is configured to communicate the movement of the rotary arm member 230 to the buffering element 220. The linkage mechanism 260 will be described later in detail with reference to FIGS. 4 to 6.

The pressing force generation element 210 has a function similar to that of the pressing force generation element 110 described with reference to FIG. 1. The buffering element 220 has a function similar to that of the buffering element 120 described with reference to FIG. 1. Accordingly, detailed description thereof will be omitted.

The swivel type glass sheet processing apparatus 200 further includes a glass condition determining section 270 and a position control section 280. The glass condition determining section 270 determines the glass condition of the glass sheet A introduced into the swivel type glass sheet processing apparatus 200. For example, the glass condition determining section 270 detects the condition of the glass sheet A by bringing a roller into contact with the edge surface of the glass sheet A introduced into the swivel type glass sheet processing apparatus 200. The pressing force generation element 210 generates a pressing force against the processing tool B according to the glass condition of the glass sheet A. The position control section 280 controls the position of the rotary arm member 230. The position control section 280 has a function similar to that of the position control section 180 described with reference to FIG. 1, and therefore detailed description thereof will be omitted.

[Linear Slide Type Glass Sheet Processing Apparatus]

Figure 3:
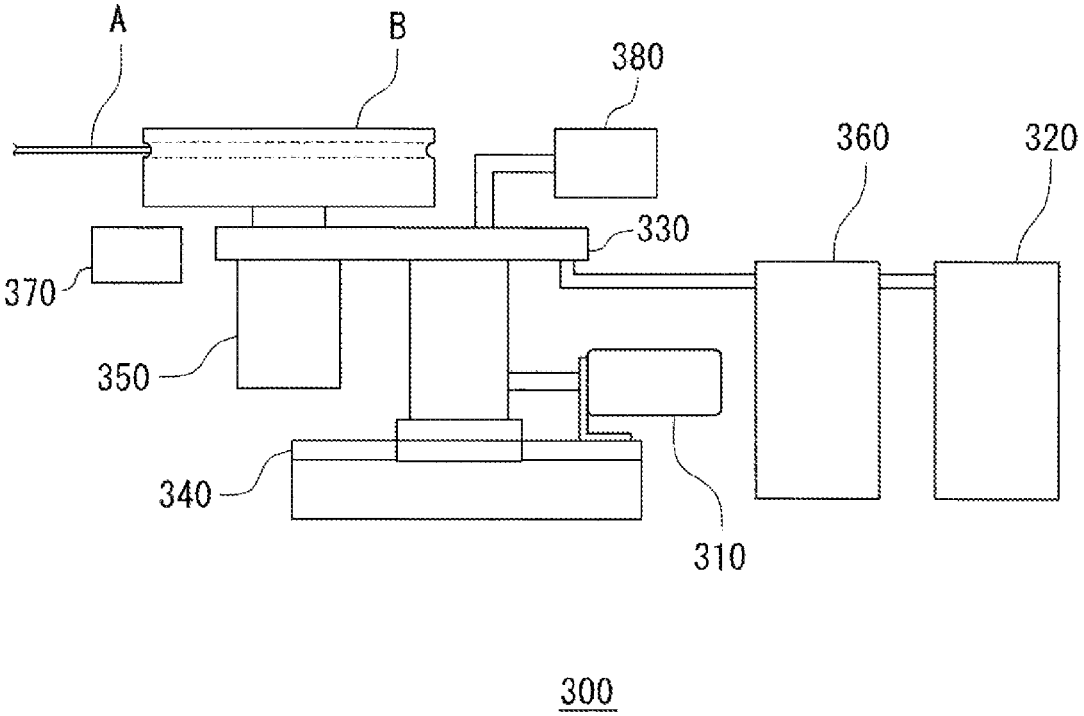
FIG. 3 is a schematic side view of a linear slide type glass sheet processing apparatus 300 according to an embodiment of the present invention.

FIG. 3 is a schematic side view of the linear slide type glass sheet processing apparatus 300 according to an embodiment of the present invention. The linear slide type glass sheet processing apparatus 300 processes the edge surface of the glass sheet A using the processing tool B. The linear slide type glass sheet processing apparatus 300 may include a pressing force generation element 310, a buffering element 320, a slide member 330, a slide rail member 340, a processing tool rotating motor 350, and a linkage mechanism 360.

The slide member 330 is connected with the processing tool B. The slide member 330 is connected with the slide rail member 340 in a linearly slidable manner. The pressing force generation element 310 generates a pressing force from the processing tool B toward the glass sheet A by pressing the slide member 330. The processing tool rotating motor 350 rotates the processing tool B. The description of the output of the processing tool rotating motor 250 with reference to FIG. 2 applies to the output of the processing tool rotating motor 350, which may be 1 kW as in the case of the output of the processing tool rotating motor 250.

The linkage mechanism 360 is configured to communicate the movement of the slide member 330 to the buffering element 320. The linkage mechanism 360 will be described later in detail with reference to FIGS. 4 to 6.

The pressing force generation element 310 has a function similar to that of the pressing force generation element 110 described with reference to FIG. 1. The buffering element 320 has a function similar to that of the buffering element 120 described with reference to FIG. 1. Accordingly, detailed description thereof will be omitted.

The linear slide type glass sheet processing apparatus 300 further includes a glass condition determining section 370 and a position control section 380. The glass condition determining section 370 has a function similar to that of the glass condition determining section 270 described with reference to FIG. 2. The position control section 380 has a function similar to that of the position control section 180 described with reference to FIG. 1. Accordingly, detailed description thereof will be omitted.

[Buffering Element]

Figure 4:
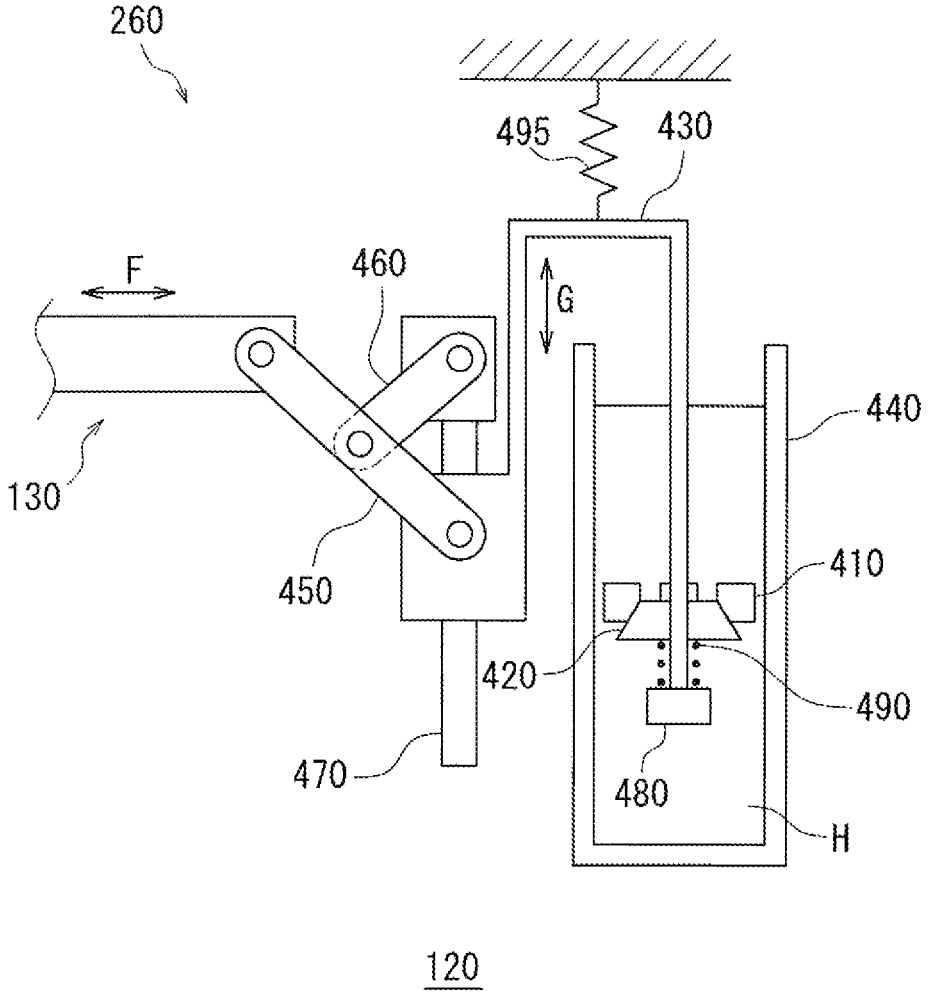
FIG. 4 is a schematic illustration of a buffering element 120 according to the embodiment of the present invention.
Figure 5:
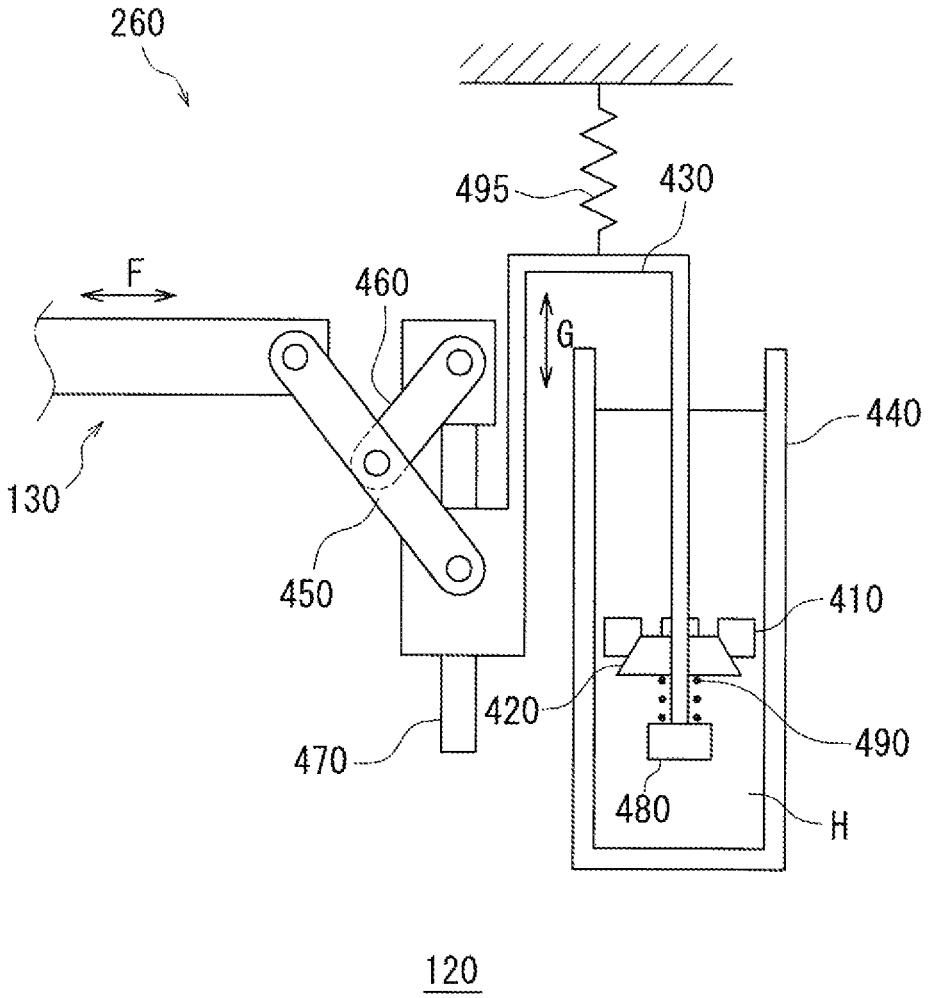
FIG. 5 is a schematic illustration of the buffering element 120 according to the embodiment of the present invention.
Figure 6:
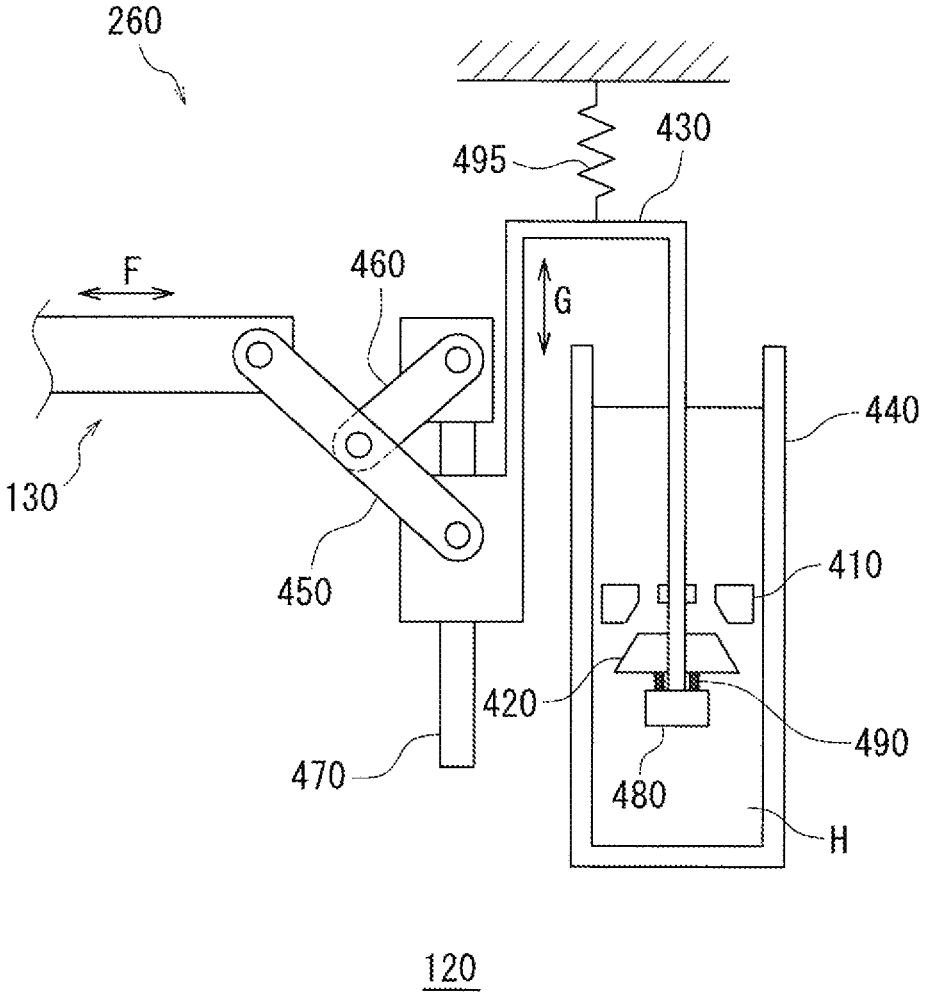
FIG. 6 is a schematic illustration of the buffering element 120 according to the embodiment of the present invention.

FIGS. 4 to 6 are schematic illustrations of the buffering element 120 according to the embodiment of the present invention. A configuration of the buffering element 120 according to the embodiment of the present invention will be described with reference to FIGS. 4 to 6. The buffering element 120 in the embodiment of the present invention is an unsealed water dashpot. Specifically, the buffering element 120 includes an orifice plate 410, a non-return valve 420, a piston 430, a chamber 440, and a working fluid H.

The piston 430 descends and ascends in the vertical direction (direction indicated by the arrow G) according to the movement of the arm member 130. The chamber 440 is filled with the working fluid H (e.g., water) and accommodates the orifice plate 410 and the non-return valve 420. The orifice plate 410 is fixed to the piston 430, and descends and ascends with the descent and ascent of the piston 430. The orifice plate 410 is a plate having a toroidal shape and configured to measure the flow rate using the difference between the pressures generated at the sides above and below the orifice plate 410.

The non-return valve 420 is closed to the action of the impact force. For example, the non-return valve 420 is a check valve. The non-return valve 420 can limit the direction of the action of the buffering element 120. When the processing tool B is shifted toward the edge surface of the glass sheet A, the buffering effect is not produced, so that the movement of the arm member 130 is not affected. When the processing tool B is shifted away from the edge surface of the glass sheet A, the buffering effect is produced, so that the movement of the arm member 130 can be buffered.

The buffering element 120 includes a piston end portion 480, a coil spring 490, and a tension spring 495. The piston end portion 480 is fixed to the piston 430 and accommodated within the chamber 440. The coil spring 490 is on top of the piston end portion 480, and the non-return valve 420 is on top of the coil spring 490. The coil spring 490 is a weak spring for supporting the weight of the non-return valve 420. One end of the tension spring 495 is fixed to the piston 430, and the other end of the tension spring 495 is fixed to a fixed wall. The tension spring 495 will be described later in detail.

The buffering element 120 according to the embodiment of the present invention is not limited to the unsealed water dashpot as long as it can buffer the impact force that the edge surface of the glass sheet A exerts on the processing tool B. That is, the buffering element 120 may be a different type of damper element. In the present specification, the non-return valve 420 and the piston 430 function as a piston mechanism.

Description of the configuration of the buffering element 120 according to the embodiment of the present invention will be continued with reference to FIGS. 4 to 6. The buffering element 120 is provided with the linkage mechanism 260. The linkage mechanism 260 functions to communicate the movement of the rotary arm member 130 to the buffering element 120. The linkage mechanism 260 in the embodiment of the present invention is a Scott Russel linkage mechanism, for example. The linkage mechanism 260 includes a first linkage member 450, a second linkage member 460, and a fixed shaft 470.

The first linkage member 450 and the second linkage member 460 are made from an undeformable material. The piston 430, the first linkage member 450, the second linkage member 460, and the fixed shaft 470 are connected together by joints.

The arm member 130 and the first linkage member 450 are connected together by the joint, and the movement of the arm member 130 in the horizontal direction (direction indicated by the arrow F) is communicated to the first linkage member 450. The first linkage member 450 and the second linkage member 460 are connected together by the joint, and the first linkage member 450 and the piston 430 are connected together by the joint. Accordingly, the movement of the first linkage member 450 is communicated to the piston 430. The second linkage member 460 and the fixed shaft 470 are connected together by the joint. The fixed shaft 470 is fixed relative to the chamber 440 and guides the descent and ascent of the piston 430 in the vertical direction (direction indicated by the arrow G).

The tension spring 495 balances the weight of the linkage. The weight of the linkage is a total weight of the orifice plate 410, the non-return valve 420, the piston 430, the first linkage member 450, the second linkage member 460, the piston end portion 480, and the coil spring 490. Where the chamber 440 has a vertically-long shape (i.e., shape to move the piston 430 in the vertical direction (direction indicated by the arrow G)), the gravity needs to be taken into consideration. That is, the arm member 130 is always urged to move toward the edge surface of the glass sheet A by the pressing force against the arm member 130 toward the edge surface of the glass sheet A. However, the center of gravity of the linkage moves with the movement of the linkage between a point where the arm member 130 is closest to the chamber 440 and a point where the arm member 130 is farthest from the chamber 440. As a result, the weight of the linkage is added to or reduced from the pressing force, preventing the pressing force from being constant in some cases.

The tension spring 495 is therefore introduced on the assumption that the pressing force has a proportional relationship with the position of the arm member 130 between the point where the arm member 130 is closest to the chamber 440 and the point where the arm member 130 is farthest from the chamber 440. As a result, the tension spring 495 supports the linkage and balances the weight of the linkage such that the weight of the linkage does not affect the pressing force wherever the arm member 130 is positioned.

The operation of the buffering element 120 will be further described with reference to FIGS. 4 to 6. FIG. 4 shows a state A. The arm member 130 is in the position farthest from the chamber 440. The non-return valve 420 blocks a part of an opening of the orifice plate 410.

FIG. 5 shows a state B. In the case of the state B, the processing tool B is in contact with fine projections on the edge surface of the glass sheet A. As a result, the arm member 130 is in the position closer to the linkage mechanism 260 in the state B than in the state A.

The piston 430 descends in the vertical direction when the arm member 130 presses the first linkage member 450 toward the linkage mechanism 260. Since the piston end portion 480 descends lower in the vertical direction in the state B than in the state A, the orifice plate 410 presses the non-return valve 420 downward in the vertical direction to keep the non-return valve 420 closed (i.e., the non-return valve 420 keeps on blocking a part of the opening of the orifice plate 410). The orifice plate 410 and the non-return valve 420 descend in the vertical direction as the state shifts from A to B, and the working fluid H below the position of the orifice plate 410 moves upward through a gap between the orifice plate 410 and the inner wall of the chamber 440 to an area above the orifice plate 410. That is, when the impact force from the edge surface of the glass sheet A acts on the processing tool B because of the presence of the fine projections on the edge surface of the glass sheet A, the buffering element 120 buffers the impact force while the pressing force generation element 110 generates the pressing force that the processing tool B exerts on the edge surface of the glass sheet A.

FIG. 6 shows a state C. The pressing force generation element 110 continues to generate the pressing force against the arm member 130 even after time from the end of the state B, and thus the arm member 130 is in a position farther from the linkage mechanism 260 in the state C than in the state B. Since the pressing force generation element 110 continues to generate the pressing force against the arm member 130, the arm member 130 pulls the first linkage member 450 away from the chamber 440. As a result, the orifice plate 410 and the piston end portion 480 ascend more in the vertical direction in the state C than in the state B, and the non-return valve 420 compresses the coil spring 490 downward in the vertical direction. Consequently, the non-return valve 420 opens (i.e., the part of the opening of the orifice plate 410, which was blocked by the non-return valve 420, opens).

As described above, the orifice plate 410 and the piston end portion 480 ascend more in the vertical direction in the state C than in the state B as the state shifts from B to C. Once the non-return valve 420 opens, the working fluid H above the position of the orifice plate 410 moves downward through the opening of the orifice plate 410 to an area below the orifice plate 410.

The arm member 130 is in a position farthest from the linkage mechanism 260 in the case of the state A out of the operation states (states A to C) of the buffering element 120. Once the processing tool B is in contact with the fine projections on the edge surface of the glass sheet A, the state shifts from A to B, and then shifts from B to C. Since the orifice plate 410 is fixed to the piston 430, and the piston end portion 480 is also fixed to the piston 430, the gap between the orifice plate 410 and the piston end portion 480 is constant. Accordingly, the non-return valve 420 moves between the orifice plate 410 and the piston end portion 480 under the force of the coil spring 490.

When the processing tool B is shifted away from the edge surface of the glass sheet A, the orifice plate 410 presses the non-return valve 420 downward in the vertical direction. Since the non-return valve 420 is kept closed, the buffering element 120 produces the buffering effect, so that the movement of the arm member 130 can be buffered. Meanwhile, since the pressing force generation element 110 continues to generate the pressing force against the arm member 130, the processing tool B is shifted toward the edge surface of the glass sheet A, and the non-return valve 420 compresses the coil spring 490 downward in the vertical direction. As a result, the non-return valve 420 opens, and the buffering effect by the buffering element 120 is eliminated. The pressing force generation element 110 generates the pressing force that the processing tool B exerts on the edge surface of the glass sheet A to keep the processing tool B in contact with the edge surface of the glass sheet A.

As described with reference to FIGS. 4 to 6, the movement of the arm member 130 in the horizontal direction (direction indicated by the arrow F) can be converted into the descent and ascent of the piston 430 in the vertical direction (direction indicated by the arrow G) when the buffering element 120 according to the embodiment of the present invention includes a Scott Russel linkage mechanism as the linkage mechanism 260. As a result, a water dashpot having a vertically-long shape can be used as the buffering element 120. Consequently, the need of using a sealing structure such as an O-ring for preventing leakage of the working fluid H can be eliminated, and the influence of the seal resistance can be ignored.

It should be noted that the present invention is not limited to the configuration in which the buffering element 120 includes a Scott Russel linkage mechanism as the linkage mechanism 260. The effect of the present invention can be obtained even when the buffering element 120 does not include the Scott Russel linkage mechanism as long as the buffering element 120 buffers the impact force that the edge surface of the glass sheet A exerts on the processing tool B.

The operation of the buffering element 120 has been described with reference to FIGS. 4 to 6 so far. The buffering element 220 described with reference to FIG. 2 and the buffering element 320 described with reference to FIG. 3 operate in the same manner as the buffering element 120. Accordingly, detailed description thereof will be omitted.

Figure 7:
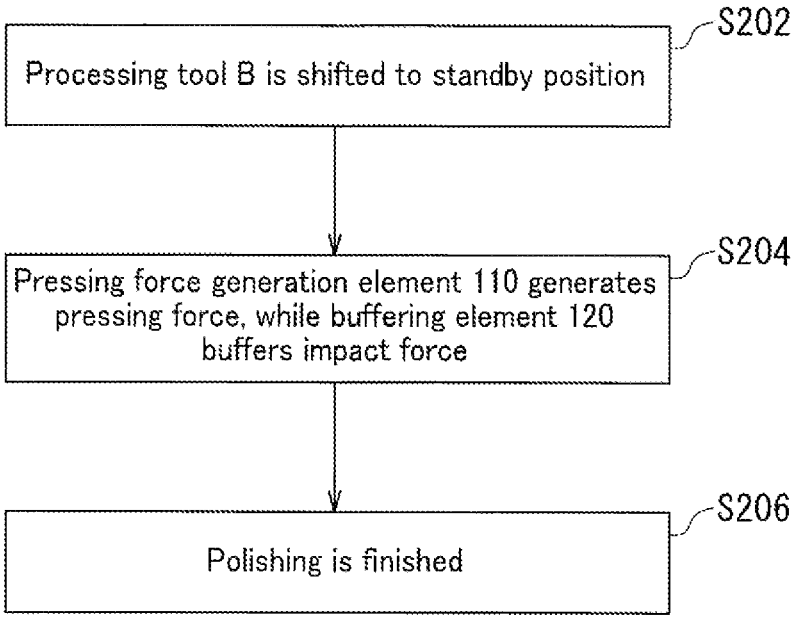
FIG. 7 is a flowchart showing a glass sheet producing method using the glass sheet processing apparatus 100 of the present embodiment.

FIG. 7 is a flowchart showing a glass sheet producing method using the glass sheet processing apparatus 100 of the present embodiment. Hereinafter, the glass sheet producing method using the glass sheet processing apparatus 100 will be described. According to the glass sheet producing method of the present invention, the glass sheet A can be produced by processing the edge surface of the glass sheet A using the processing tool B. The glass sheet producing method is achieved through Steps S202 to S206. Step S204 functions as a step of buffering the impact force while generating the pressing force.

Step S202: The processing tool B is shifted to the standby position (original point).

Step S204: The pressing force generation element 110 generates the pressing force that the processing tool B exerts on the edge surface of the glass sheet A. The processing tool B is brought into contact with the edge surface of the glass sheet A, whereupon the polishing of the glass sheet A is started. The processing tool B is brought into contact with the edge surface of the glass sheet A such that the arm member 130 forms an angle of 25° to 35° to the advance direction of the glass sheet A.

When the impact force from the edge surface of the glass sheet A acts on the processing tool B because of the presence of the fine projections on the edge surface of the glass sheet A, the buffering element 120 buffers the impact force while the pressing force generation element 110 generates the pressing force that the processing tool B exerts on the edge surface of the glass sheet A.

Step S206: The arm member 130 separates the processing tool B from the edge surface of the glass sheet A and shifts the processing tool B to the retraction position, whereupon the polishing is finished. The retraction position coincides with the standby position (original point) in the present embodiment.

According to the glass sheet processing apparatus and the glass sheet producing method of the present embodiment, as described with reference to FIGS. 1 to 7, the impact force that the edge surface of the glass sheet A exerts on the processing tool B can be buffered while the pressing force that the processing tool B exerts on the edge surface of the glass sheet A is generated. Thus, the processing tool B can be prevented from being flicked off the edge surface of the glass sheet A by the impact force on the processing tool B that is increased with the increase in the conveyance speed of the glass sheet A. As a result, the conveyance speed in the glass sheet production can be increased, and the quantity of glass sheets A that can be conveyed to a following process can be increased.

Figure 8:
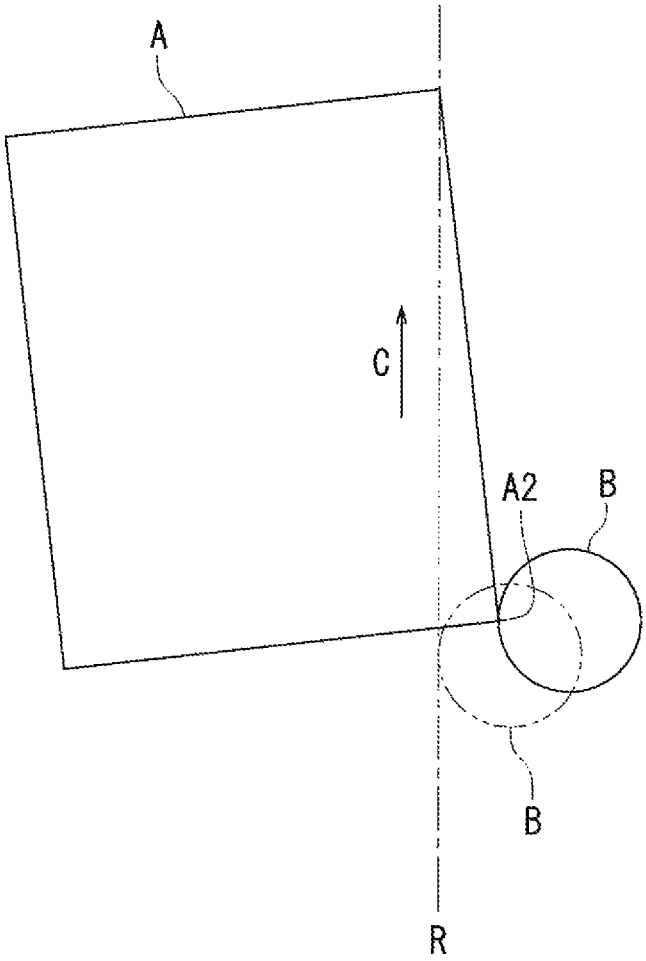
FIG. 8 is a schematic top view showing a manner of polishing an edge surface of a glass sheet A at an angle to a feed direction C.

In the embodiment described with reference to FIG. 1, the processing tool B polishes the edge surface of the glass sheet A in parallel with the feed direction C. Alternatively, the processing tool B may polish the edge surface of the glass sheet A at an angle to the feed direction C. FIG. 8 is a schematic top view showing the manner of polishing the edge surface of the glass sheet A at an angle to the feed direction C. In FIG. 8, a trailing end A2 of the edge surface of the glass sheet A deviates from an orbit R thereof in the case of conveyance parallel to the feed direction to a side closer to the processing tool B. When the edge surface of the glass sheet A is polished while taking the posture as shown in FIG. 8, and the processing tool B is returned from a polishing end position (as indicated by solid lines) to the standby position (as indicated by dashed and double dotted lines), the processing tool B may scratch the edge surface of the glass sheet A, and therefore the edge surface of the glass sheet A or the processing tool B may be damaged. It is therefore necessary to first retract the processing tool B in a direction to separate the processing tool B from the edge surface of the glass sheet A once the polishing is finished, and then return it to the standby position. That is, the processing tool B needs to be controlled such that it is shifted in sequence among the three positions: the standby position, the polishing position, and the retraction position where the processing tool B is retracted in the separating direction beyond the standby position.

Figure 9:
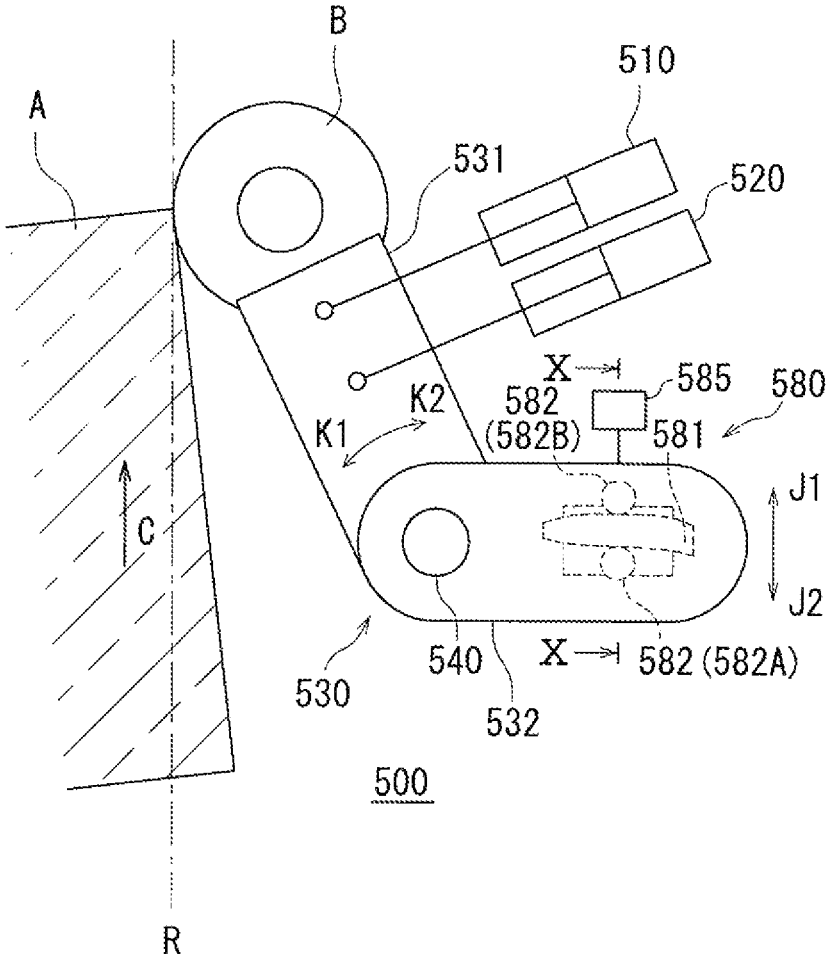
FIG. 9 is a schematic top view of a glass sheet processing apparatus 500 according to an embodiment of the present invention.

FIG. 9 is a schematic top view of a glass sheet processing apparatus 500 according to an embodiment of the present invention. The processing tool B in the glass sheet processing apparatus 500 of the present embodiment is controlled such that it is shifted in sequence among the three positions: the standby position, the polishing position, and the retraction position where the processing tool B is retracted in the separating direction beyond the standby position. Hereinafter, the glass sheet processing apparatus 500 of the present embodiment will be described with reference to FIG. 9.

The glass sheet processing apparatus 500 processes the edge surface of the glass sheet A using the processing tool B. The glass sheet processing apparatus 500 includes a pressing force generation element 510, a buffering element 520, a rotary arm member 530, a support shaft member 540, a processing tool rotating motor (not shown), a linkage mechanism (not shown), a glass condition determining section (not shown), and a position control section 580. The pressing force generation element 510, the buffering element 520, the rotary arm member 530, the support shaft member 540, the processing tool rotating motor, the linkage mechanism, and the glass condition determining section are as described in the embodiment shown in FIG. 2, and therefore description thereof will be omitted.

The rotary arm member 530 is connected with the processing tool B. The support shaft member 540 is rotatably connected with the rotary arm member 530. The processing tool B is shifted in a direction to press the processing tool B against the edge surface of the glass sheet A (direction indicated by the arrow K1 in FIG. 9: pressing direction) or in a direction to separate the processing tool B from the edge surface of the glass sheet A (direction indicated by the arrow K2 in FIG. 9: separating direction) by the rotation of the rotary arm member 530.

The rotary arm member 530 in the present embodiment has a first arm portion 531 and a second arm portion 532. One end of the first arm portion 531 is connected with the processing tool B. The other end of the first arm portion 531 and one end of the second arm portion 532 are connected with each other. The support shaft member 540 is connected with a region where the first arm portion 531 and the second arm portion 532 are connected. The pressing force generation element 510 generates the pressing force from the processing tool B toward the glass sheet A by applying a couple of forces to the first arm portion 531 of the rotary arm member 530.

The position control section 580 controls the position of the rotary arm member 530 such that the processing tool B is shifted in sequence among the standby position, the polishing position, and the retraction position. The standby position is where the processing tool B is on standby for the contact with the edge surface of the glass sheet A. The polishing position is where the processing tool B is in contact with the edge surface of the glass sheet A and is polishing the edge surface. The retraction position is where the processing tool B has been retracted in the separating direction beyond the standby position. The position control section 580 in the embodiment of the present invention includes a cam member 581 (intercylinder cam) and cam followers 582 (arm controlling elements).

The cam member 581 is rotationally driven by a cam member rotating motor 585. The cam member rotating motor 585 in the present embodiment is a servomotor, for example. The cam member 581 is rotated by the cam member rotating motor 585 at a predetermined speed and by a predetermined phase (angle). The servomotor may be provided with a reducer.

The cam followers 582 are connected with the rotary arm member 530 to coordinate with the rotary arm member 530. The cam followers 582 in the present embodiment are connected with the second arm portion 532. The cam followers 582 are driven by the rotation of the cam member 581 and displaced in the axial direction (direction indicated by the arrow J1 or direction indicated by the arrow J2) of the cam member 581. The rotary arm member 530 rotates in conjunction with the cam followers 582 being displaced in the direction indicated by the arrow J1 to shift the processing tool B in the pressing direction (direction indicated by the arrow K1). Or, the rotary arm member 530 rotates in conjunction with the cam followers 582 being displaced in the direction indicated by the arrow J2 to shift the processing tool B in the separating direction (direction indicated by the arrow K2).

Figure 10:
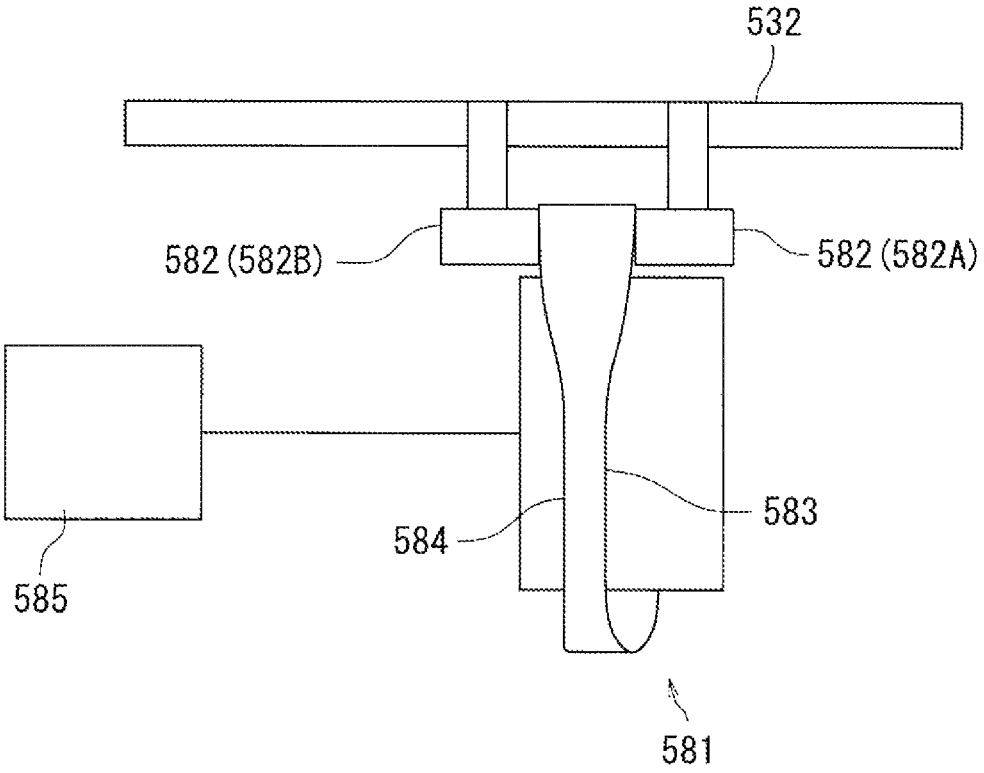
FIG. 10 is a schematic cross sectional view of a position control section 580 as seen from a direction of arrows X-X in FIG. 9.

FIG. 10 is a schematic cross sectional view of the position control section 580 as seen from a direction of arrows X-X in FIG. 9. Description of the position control section 580 will be continued with reference to FIGS. 9 and 10. Specifically, the position control section 580 has the two cam followers 582 (hereinafter, may be referred to as a first cam follower 582A and a second cam follower 582B). The first cam follower 582A and the second cam follower 582B are disposed on the second arm portion 532 with a predetermined gap therebetween, and are movable with the second arm portion 532 while maintaining the predetermined gap.

The cam member 581 is a cylindrical end cam having a first cam surface 583 and a second cam surface 584 opposite to the first cam surface 583. The first cam surface 583 is on one side of the rotational axis of the cam member 581. The first cam surface 583 can be brought into contact with the first cam follower 582A during the time when the cam member 581 is rotating. The second cam surface 584 is on the other side of the rotational axis of the cam member 581. The second cam surface 584 can be brought into contact with the second cam follower 582B during the time when the cam member 581 is rotating.

Figure 11:
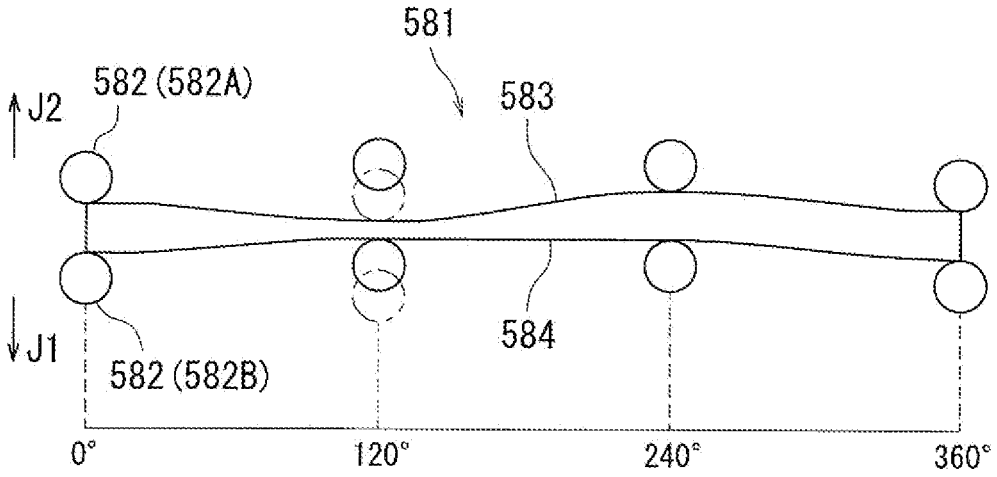
FIG. 11 is a diagram showing positions of cam followers 582 according to the rotation phase of a cam member 581.
Figure 12A:
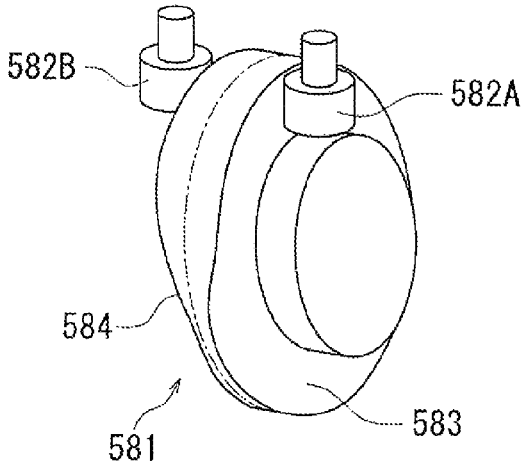
FIG. 12A is a diagram showing a state of the cam member 581 rotated by a first rotation phase.
Figure 12B:
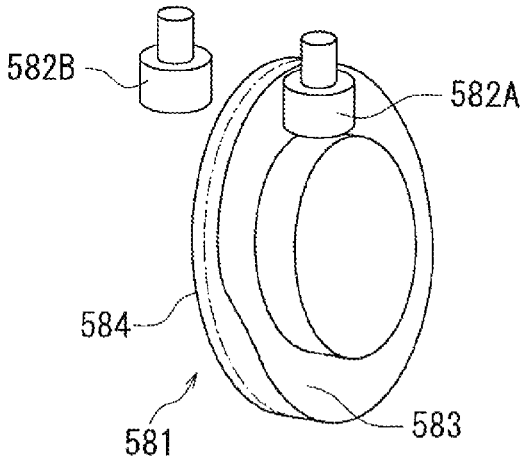
FIG. 12B is a diagram showing a state of the cam member 581 rotated by a second rotation phase.
Figure 12C:
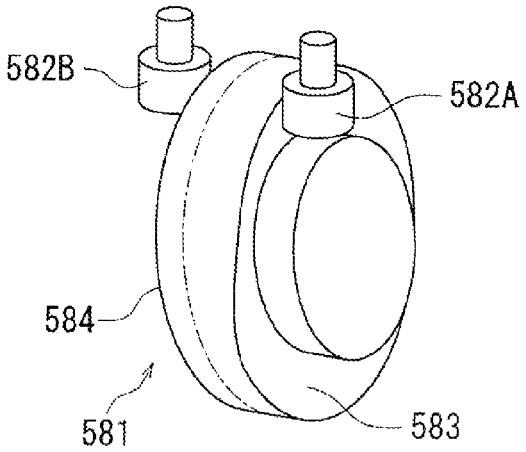
FIG. 12C is a diagram showing a state of the cam member 581 rotated by a third rotation phase.
Figure 13A:
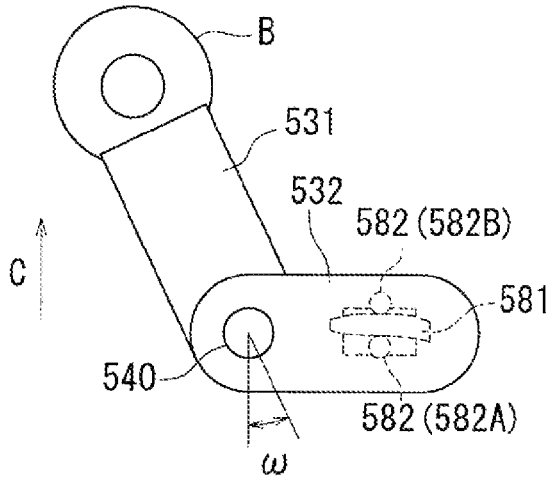
FIG. 13A is a diagram showing a processing tool B in a standby position.
Figure 13B:
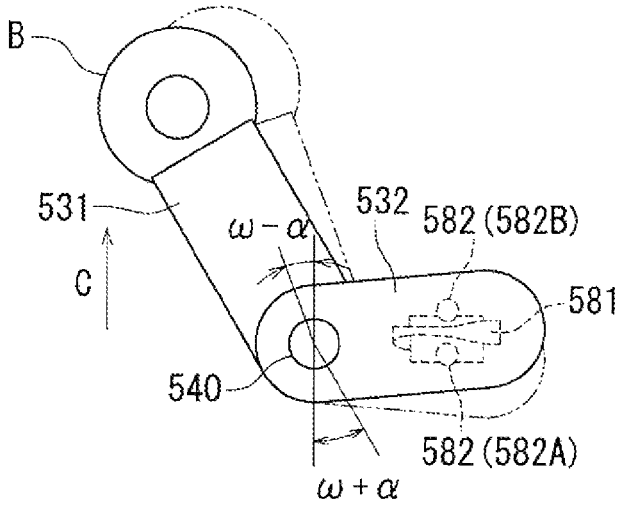
FIG. 13B is a diagram showing the processing tool B in a polishing position.
Figure 13C:
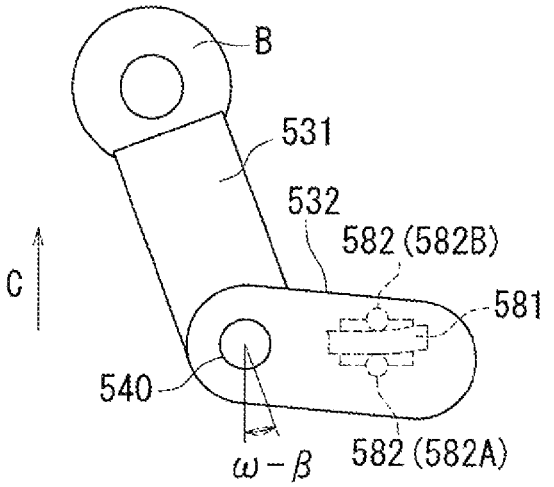
FIG. 13C is a diagram showing the processing tool B in a retraction position.

FIG. 11 is a diagram showing positions of the cam followers 582 according to the rotation phase of the cam member 581. FIGS. 12A to 12C are schematic perspective views of the position control section 580. FIG. 12A shows a state of the cam member 581 rotated by a first rotation phase. FIG. 12B shows a state of the cam member 581 rotated by a second rotation phase. FIG. 12C shows a state of the cam member 581 rotated by a third rotation phase. FIGS. 13A to 13C are schematic top views showing the position of the processing tool B being shifted with the displacement of the cam followers 582. FIG. 13A shows the processing tool B in the standby position. FIG. 13B shows the processing tool B in the polishing position. FIG. 13C shows the processing tool B in the retraction position. Hereinafter, the shape of the cam member 581, and the relationship between the rotation of the cam member 581 and the position of the processing tool B will be described with reference to FIGS. 11, 12A to 12C, and 13A to 13C.

The position and state of the contact between the first cam surface 583 and the first cam follower 582A, and the position and state of the contact between the second cam surface 584 and the second cam follower 582B change in conjunction with the rotation of the cam member 581. Such change shifts the processing tool B in sequence among the standby position, the polishing position, and the retraction position. Specifically, the cam member 581 is driven by the cam member rotating motor 585 and rotated by the first rotation phase (0°), the second rotation phase (120°), and the third rotation phase (240°) in sequence. The rotation of the cam member 581 by the first rotation phase shifts the processing tool B to the standby position. The rotation of the cam member 581 by the second rotation phase shifts the processing tool B to the processing position. The rotation of the cam member 581 by the third rotation phase shifts the processing tool B to the retraction position.

[Standby Position]

The width of the cam member 581 with respect to a portion thereof that comes between the first cam follower 582A and the second cam follower 582B in the case of the first rotation phase is equal to the gap between the first cam follower 582A and the second cam follower 582B. The first cam follower 582A is in contact with the first cam surface 583, and the second cam follower 582B is in contact with the second cam surface 584. Accordingly, the displacement of the first cam follower 582A and the second cam follower 582B in the direction indicated by the arrow J1 (direction of the displacement of the cam followers for shifting the processing tool B in the pressing direction) or in the direction indicated by the arrow J2 (direction of the displacement of the cam followers for shifting the processing tool B in the separating direction) is restricted. Thus, the rotary arm member 530 is put in a locked state where it is non-rotatable. Accordingly, in the case of the first rotation phase, the processing tool B is in a predetermined position (the standby position in the present embodiment) where it does not shift. As shown in FIG. 13A, an included angle ω formed by the feed direction C and the longitudinal direction of the first arm portion 531 of the rotary arm member 530 is 30°, for example, when the processing tool B is in the standby position.

[Polishing Position]

The width of the cam member 581 with respect to a portion thereof that comes between the first cam follower 582A and the second cam follower 582B in the case of the second rotation phase (hereinafter, may be referred to as a second-rotation-phase cam width) is smaller than the gap between the first cam follower 582A and the second cam follower 582B. The first cam follower 582A and the second cam follower 582B can be freely displaced in the direction indicated by the arrow J1 or in the direction indicated by the arrow J2 within a predetermined distance (distance obtained by subtracting the second-rotation-phase cam width from the gap between the cam followers). Thus, the rotary arm member 530 is put in a free state where it is rotatable.

Accordingly, in the case of the second rotation phase, the displacement of the cam member 581 and the cam member 582 in the direction indicated by the arrow J1 shifts the processing tool B in the pressing direction away from the standby position as shown in FIG. 13B. When the processing tool B is in a position where it has been shifted maximally in the pressing direction (as indicated by solid lines), the included angle formed by the feed direction C and the longitudinal direction of the first arm portion 531 of the rotary arm member 530 is "ω+α". In addition, the displacement of the cam member 581 and the cam member 582 shifts the processing tool B in the separating direction beyond the standby position. When the processing tool B is in a position where it has been shifted maximally in the separating direction (as indicated by dashed and double dotted lines), the included angle formed by the feed direction C and the longitudinal direction of the first arm portion 531 of the rotary arm member 530 is "ω−α". For example, α is 1°. Herein, α can be adjusted by changing the distance obtained by subtracting the second-rotation-phase cam width from the gap between the cam followers.

[Retraction Position]

The width of the cam member 581 with respect to a portion thereof that comes between the first cam follower 582A and the second cam follower 582B in the case of the third rotation phase is equal to the gap between the first cam follower 582A and the second cam follower 582B. The first cam follower 582A is in contact with the first cam surface 583, and the second cam follower 582B is in contact with the second cam surface 584. Accordingly, the displacement of the first cam follower 582A and the second cam follower 582B in the directions indicated by the arrows J is restricted. Thus, the rotary arm member 530 is put in a locked state where it is non-rotatable.

The position of the first cam surface 583 (or the second cam surface 584) in the case of the third rotation phase is offset in the direction indicated by the arrow J2 by a predetermined distance from the position of the first cam surface 583 (or the second cam surface 584) in the case of the first rotation phase. Accordingly, driven by the cam member 581 rotated by the third rotation phase, the first cam follower 582A and the second cam follower 582B are displaced in the direction indicated by the arrow J2 to shift the processing tool B in the separating direction beyond the standby position. As shown in FIG. 13C, the included angle formed by the feed direction C and the longitudinal direction of the first arm portion 531 of the rotary arm member 530 is "ω−β" when the processing tool B is in the retraction position after having been shifted in the separating direction.

In the present embodiment, β is an angle equal to α. That is, the position of the processing tool B having been shifted maximally in the separating direction (ω−α) coincides with the retraction position (ω−β) of the processing tool B. Herein, β can be adjusted by changing the distance from the position of the first cam surface 583 (or the second cam surface 584) in the case of the first rotation phase by which the position of the first cam surface 583 (or the second cam surface 584) in the case of the third rotation phase is offset.

The first cam surface 583 and the second cam surface 584 are formed such that the orbits of the first cam follower 582A and the second cam follower 582B in the circumferential direction of the cam member 581 between the first rotation phase and the second rotation phase, and between the second rotation phase and the third rotation phase are represented by constant velocity curves.

The glass sheet processing apparatus 500 of the present embodiment has been described with reference to FIGS. 9 to 13. According to the present embodiment, the processing tool B is controlled such that it is shifted in sequence among the standby position, the polishing position, and the retraction position. Herein, the retraction position is where the processing tool B has been retracted in the separating direction beyond the standby position. It is therefore possible to first retract the processing tool B in the separating direction, and then return it to the standby position after the completion of the polishing, when the edge surface of the glass sheet A is polished while taking the posture as shown in FIG. 8. As a result, the processing tool B can be prevented from scratching the edge surface of the glass sheet A, and the glass sheet A or the processing tool B can be prevented from being damaged because of the scratching. According to the present embodiment, the control of the processing tool B to be shifted among the three positions can be achieved by rotating the cam member 581 in increments of 120°. The glass sheet processing apparatus 500 of the present embodiment therefore has a simpler structure and is less likely to cause delay in operation compared with an apparatus that achieves the shifting of a processing tool to the retraction position by a translatory mechanism, which shifts the processing tool back and forth.

Although the first rotation phase is 0°, the second rotation phase is 120°, and the third rotation phase is 240° in the present embodiment, the present invention is not limited thereto. The first rotation phase, the second rotation phase, and the third rotation phase can be determined according to demands in terms of the control of the operation of the processing tool B. In addition, the first cam surface 583 and the second cam surface 584 may be formed such that the orbits of the first cam follower 582A and the second cam follower 582B in the circumferential direction of the cam member 581 are represented by straight lines within a range of 5° either side of each of the first rotation phase, the second rotation phase, and the third rotation phase. Consequently, the processing tool B can be shifted to a desired position even if the rotation angle of the cam member 581 is slightly different from the desired angle (0°, 120°, or 240°).

Figure 14:
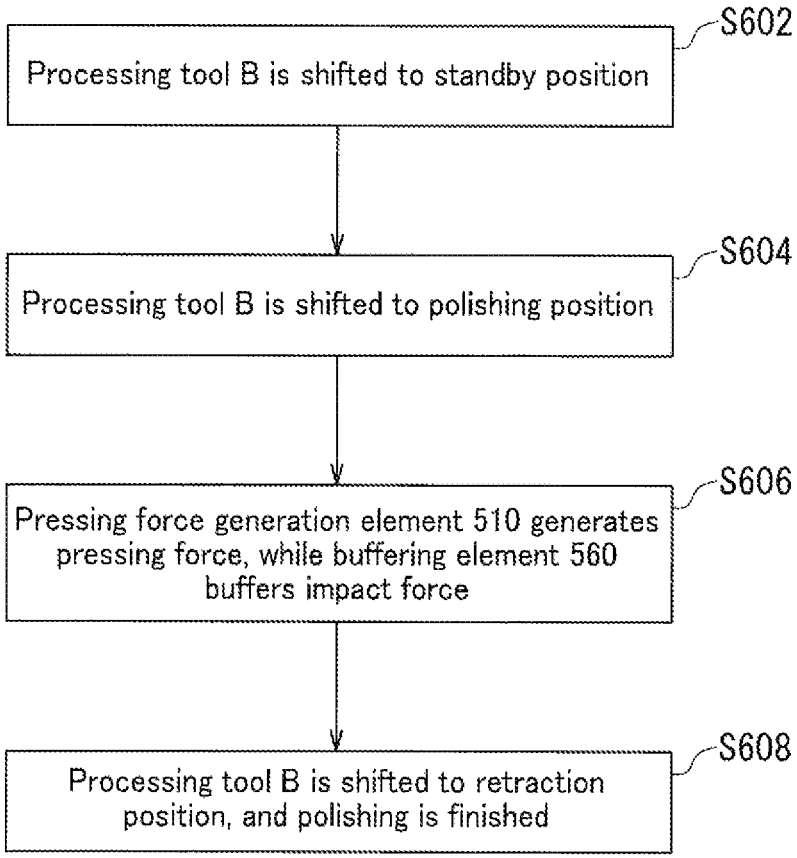
FIG. 14 is a flowchart showing a glass sheet producing method using the glass sheet processing apparatus 500 of the present embodiment.

FIG. 14 is a flowchart showing a glass sheet producing method using the glass sheet processing apparatus 500 of the present embodiment. Hereinafter, the glass sheet producing method using the glass sheet processing apparatus 500 will be described with reference to FIGS. 9 to 14. The glass sheet producing method includes controlling the processing tool B such that it is shifted in sequence among the standby position, the polishing position, and the retraction position. The glass sheet producing method is achieved through Steps S602 to S608.

Step S602: The processing tool B is shifted to the standby position. Specifically, the cam member 581 is driven by the cam member rotating motor 585 and rotated by the first rotation phase. The processing tool B is shifted to the standby position in conjunction with the cam member 581 rotated by the first rotation phase. The processing tool B does not move freely in the standby position because the rotary arm member 530 is in the locked state.

Step S604: The processing tool B is shifted to the polishing position. Specifically, the cam member rotating motor 585 is rotated in timed relation to the contact between the processing tool B and the glass sheet A such that the processing tool B having been shifted to the polishing position comes into contact with the edge surface of the glass sheet A. The cam member 581 is driven by the cam member rotating motor 585 and rotated by the second rotation phase. The processing tool B is shifted in conjunction with the cam member 581 rotated by the second rotation phase to reach the polishing position at the time when the processing tool B comes into contact with the glass sheet A. The processing tool B can be shifted in the pressing direction or in the separating direction in the polishing position because the rotary arm member 530 is in the free state.

Step S606: The pressing force generation element 510 generates the pressing force that the processing tool B exerts on the edge surface of the glass sheet A. The first processing tool B polishes the edge surface of the glass sheet A from a leading end A1 to the trailing end A2 while the pressing force is being generated. Pressed by the trailing end A2 of the edge surface deviating from the orbit R to the side closer to the processing tool B, the processing tool B is gradually shifted in the separating direction.

When the impact force from the edge surface of the glass sheet A acts on the processing tool B because of the presence of the fine projections on the edge surface of the glass sheet A, the buffering element 520 buffers the impact force while the pressing force generation element 510 generates the pressing force that the processing tool B exerts on the edge surface of the glass sheet A.

Step S608: The processing tool B is shifted to the retraction position, whereupon the polishing is finished. Specifically, the cam member 581 is driven by the cam member rotating motor 585 and rotated by the third rotation phase once the polishing by the processing tool B reaches the polishing end position. The processing tool B is shifted in the separating direction to the retraction position in conjunction with the cam member 581 rotated by the third rotation phase. The processing tool B does not move freely in the retraction position because the rotary arm member 530 is in the locked state.

For successively processing another glass sheet A, Steps S602 to S608 are repeated.

According to the glass sheet processing apparatus 500 and the glass sheet producing method of the present embodiment, as described with reference to FIGS. 9 to 14, the processing tool B can be controlled such that it is first retracted in the separating direction away from the edge surface of the glass sheet A once the polishing is finished, and then returned to the standby position. Since the processing tool B is out of contact with the edge surface of the glass sheet A when returned to the standby position, the processing tool B can be prevented from scratching the edge surface of the glass sheet, and the glass sheet A or the processing tool B can be prevented from being damaged because of the scratching.

In addition, according to the glass sheet processing apparatus 500 and the glass sheet producing method of the present embodiment, the rotary arm member 530 is in the locked state, and therefore the processing tool B does not move freely until the processing tool B comes into contact with the edge surface of the glass sheet A. Accordingly, the vibration of the processing tool B to be generated when the processing tool B comes into contact with the edge surface of the glass sheet A to start the polishing can be reduced even if the glass sheet A or the processing tool B is conveyed at a high speed.

In the embodiment described above, $\alpha$ is 1°, but a may not be 1°. Likewise, $\beta$ is an angle equal to $\alpha$, but $\beta$ may be different from $\alpha$.

In the embodiment described above, the position control section 580 is an essential component, but the buffering element 520 is not necessarily an essential component. Even without the buffering element 520, the glass sheet processing apparatus 500 can control the processing tool B such that it is shifted in sequence among the three positions: the standby position, the polishing position, and the retraction position. In one embodiment, a glass sheet processing apparatus described hereinafter is within the scope of the present invention.

The glass sheet processing apparatus according to the embodiment of the present invention includes: a pressing force generation element configured to generate a pressing force that a processing tool exerts on an edge surface of a glass sheet; and a position control section configured to control the processing tool such that it is shifted in sequence among a standby position, a polishing position, and a retraction position. Herein, the standby position is where the processing tool is on standby for contact with the edge surface of the glass sheet. The polishing position is where the processing tool is in contact with the edge surface of the glass sheet and is polishing the edge surface. The retraction position is where the processing tool has been retracted in a direction to separate the processing tool from the edge surface of the glass sheet beyond the standby position. In one embodiment, a glass sheet producing method including controlling a processing tool such that it is shifted in sequence among a standby position, a polishing position, and a retraction position is also within the scope of the present invention.

Although a grinding stone is mentioned as an example of the processing tool B, and the processing tool B performs polishing on the edge surface of the glass sheet A in the glass sheet processing apparatuses and the glass sheet producing method of the present invention, the present invention is not limited thereto. The processing tool B may be any tool other than the grinding stone as long as it can process the edge surface of the glass sheet A. Furthermore, the present invention can be applied to any processing on the glass sheet A other than polishing (e.g., grinding) as long as the processing is directed to the edge surface of the glass sheet A.

INDUSTRIAL APPLICABILITY

The glass sheet processing apparatus and the glass sheet producing method of the present invention can be suitably employed for processing of a glass sheet and production of a glass sheet.

REFERENCE SIGNS LIST

A glass sheet
B processing tool
100 glass sheet processing apparatus
110 pressing force generation element

120 buffering element
130 arm member
180 position control section
200 swivel type glass sheet processing apparatus
210 pressing force generation element
220 buffering element
230 rotary arm member
240 support shaft member
250 processing tool rotating motor
260 linkage mechanism
270 glass condition determining section
280 position control section
300 linear slide type glass sheet processing apparatus
310 pressing force generation element
320 buffering element
330 slide member
340 slide rail member
350 processing tool rotating motor
360 linkage mechanism
370 glass condition determining section
380 position control section
410 orifice plate
420 non-return valve
430 piston
440 chamber
H working fluid
450 first linkage member
460 second linkage member
470 fixed shaft
480 piston end portion
490 coil spring
500 glass sheet processing apparatus
510 pressing force generation element
520 buffering element
530 rotary arm member
531 first arm portion
532 second arm portion
540 support shaft member
580 position control section
581 cam member
582 cam follower
583 first cam surface
584 second cam surface
585 cam member rotating motor

The invention claimed is:

1. A glass sheet processing apparatus to process an edge surface of a glass sheet using a processing tool, comprising:

a pressing force generation element configured to generate a pressing force that the processing tool exerts on the edge surface of the glass sheet; and a buffering element configured to buffer an impact force that the edge surface of the glass sheet exerts on the processing tool, wherein the buffering element buffers only a first force that the edge surface of the glass sheet exerts on the processing tool without buffering a second force that the processing tool exerts on the edge surface of the glass sheet.

2. The glass sheet processing apparatus of claim 1, further comprising: a position control section configured to control the processing tool such that it is shifted in sequence among a standby position, a polishing position, and a retraction position, wherein the standby position is where the processing tool is on standby for contact with the edge surface of the glass sheet, the polishing position is where the processing tool is in contact with the edge surface of the glass sheet and is polishing the edge surface, and the retraction position is where the processing tool has been retracted in a direction to separate the processing tool from the edge surface of the glass sheet beyond the standby position.

3. The glass sheet processing apparatus of claim 1, wherein the buffering element is a dashpot.

4. The glass sheet processing apparatus of claim 3, wherein the dashpot includes water as a working fluid.

5. The glass sheet processing apparatus of claim 3, wherein the dashpot includes a piston mechanism, and the piston mechanism has a non-return valve to be closed to an action of the impact force.

6. The glass sheet processing apparatus of claim 2, comprising a rotary arm member and a support shaft member, wherein the processing tool is connected with the rotary arm member, and the rotary arm member is rotatably connected with the support shaft member, and the pressing force generation element generates the pressing force by applying a couple of forces to the rotary arm member.

7. The glass sheet processing apparatus of claim 6, wherein the position control section includes:

a cam member to be rotationally driven; and a cam follower to be driven by the rotation of the cam member, the rotary arm member operates in conjunction with the cam follower, the cam follower is displaced relative to the cam member to apply a couple of forces to the rotary arm member, and the processing tool is shifted to the standby position, the polishing position, or the retraction position in response to the application of the couple of forces to the rotary arm member.

8. The glass sheet processing apparatus of claim 7, wherein the cam follower includes a first cam follower and a second cam follower configured to be movable while maintaining a predetermined gap therebetween, the cam member is a cylindrical end cam having, on one side, a first cam surface capable of being brought into contact with the first cam follower and, on the other side, a second cam surface capable of being brought into contact with the second cam follower, the processing tool is shifted in sequence among the standby position, the polishing position, and the retraction position by change in the position and state of contact between the first cam surface and the first cam follower, and the position and state of contact between the second cam surface and the second cam follower in conjunction with the rotation of the cam member, the rotary arm is in a locked state, in which it is non-rotatable, in the standby position and the retraction position, and the rotary arm is in a free state, in which it is rotatable, in the polishing position.

9. The glass sheet processing apparatus of claim 8, wherein the processing tool is shifted to the standby position when the cam member is rotated by a first rotation phase, the processing tool is shifted to the polishing position when the cam member is rotated by a second rotation phase, the processing tool is shifted to the retraction position when the cam member is rotated by a third rotation phase, a width of the cam member with respect to a portion thereof that comes between the first cam follower and the second cam follower in the case of the first rotation phase and the third rotation phase is equal to the gap between the first cam follower and the second cam follower, the width of the cam member with respect to a portion thereof that comes between the first cam follower and the second cam follower in the case of the second rotation phase is smaller than the gap between the first cam follower and the second cam follower, the position of the first cam surface in the case of the third rotation phase is offset toward one side in an axial direction of the cam member by a predetermined distance from the position of the first cam surface in the case of the first rotation phase.

10. The glass sheet processing apparatus of claim 1, comprising:

a slide member and a slide rail member, wherein the processing tool is connected with the slide member, and the slide member is connected with the slide rail member in a linearly slidable manner, and the pressing force generation element generates the pressing force by pressing the slide member.

11. The glass sheet processing apparatus of claim 1, wherein the buffering element includes a Scott Russel linkage mechanism configured to convert a direction in which the impact force acts from the horizontal direction into the vertical direction.

12. A glass sheet processing apparatus to process an edge surface of a glass sheet using a processing tool, comprising:

a pressing force generation element configured to generate a pressing force that the processing tool exerts on the edge surface of the glass sheet;

a position control section configured to control the processing tool such that it is shifted in sequence among a standby position, a polishing position, and a retraction position;

a support shaft member; and a rotary arm member rotatably connected with the support shaft member, wherein the standby position is where the processing tool is on standby for contact with the edge surface of the glass sheet, the polishing position is where the processing tool is in contact with the edge surface of the glass sheet and is polishing the edge surface, the retraction position is where the processing tool has been retracted in a direction to separate the processing tool from the edge surface of the glass sheet beyond the standby position, the processing tool is connected with the rotary arm member, and the pressing force generation element generates the pressing force by applying a couple of forces to the rotary arm member.

13. A glass sheet producing method for producing a glass sheet having a processed edge surface by processing the edge surface of the glass sheet using a processing tool, comprising:

generating a pressing force that the processing tool exerts on the edge surface of the glass sheet while buffering an impact force that the edge surface of the glass sheet exerts on the processing tool, wherein the buffering an impact force includes buffering only a first force that the edge surface of the glass sheet exerts on the processing tool without buffering a second force that the processing tool exerts on the edge surface of the glass sheet.

14. A glass sheet producing method for producing a glass sheet having a processed edge surface by processing the edge surface of the glass sheet using a processing tool, wherein the processing tool is connected with a rotary arm member, the rotary arm member is rotatably connected with a support shaft member, the method comprises controlling the processing tool such that it is shifted in sequence among a standby position, a polishing position, and a retraction position, the standby position is where the processing tool is on standby for contact with the edge surface of the glass sheet, the polishing position is where the processing tool is in contact with the edge surface of the glass sheet and is polishing the edge surface, the retraction position is where the processing tool has been retracted in a direction to separate the processing tool from the edge surface of the glass sheet beyond the standby position, and a pressing force generation element generates a pressing force that the processing tool exerts on the edge surface of the glass sheet by applying a couple of forces to the rotary arm member when the processing tool is in contact with the edge surface of the glass sheet in the polishing position.

* * * * *